US006486596B1

(12) United States Patent
Inoue et al.

(10) Patent No.: US 6,486,596 B1
(45) Date of Patent: Nov. 26, 2002

(54) BRAUN COLOR CATHODE RAY TUBE HAVING SHADOW MASK HORIZONTAL PITCH NOVELTY

(75) Inventors: Yuichi Inoue, Mobara (JP); Katsuyoshi Tamura, Mobara (JP)

(73) Assignee: Hitachi, Ltd., Tokyo (JP)

( * ) Notice: Subject to any disclaimer, the term of this patent is extended or adjusted under 35 U.S.C. 154(b) by 163 days.

(21) Appl. No.: 09/644,071

(22) Filed: Aug. 23, 2000

(51) Int. Cl.[7] ..... H01J 29/07
(52) U.S. Cl. ..... 313/402; 313/403; 313/408
(58) Field of Search ..... 313/402, 403, 313/408, 477 R

(56) References Cited

FOREIGN PATENT DOCUMENTS

JP 57-34640 2/1982

*Primary Examiner*—Michael H. Day
*Assistant Examiner*—Glenn Zimmerman
(74) *Attorney, Agent, or Firm*—Antonelli, Terry, Stout & Kraus, LLP

(57) ABSTRACT

A Braun tube for use in a TV receiver or the like, in which its screen does not need high resolution, but the brightness of the screen is important. The Braun tube has a panel with a flat outer surface, an electron gun arranged in an in-line manner and a phosphor screen whose phosphors are arranged in a delta pattern, and the horizontal pitch of a shadow mask can be varied in the direction of the Y-axis. The mechanical strength of the shadow mask is improved by making the curvature of the shadow mask larger than the curvature of the inner surface of the panel in the direction of the vertical axis of the screen.

21 Claims, 9 Drawing Sheets

FIG. 2(a)
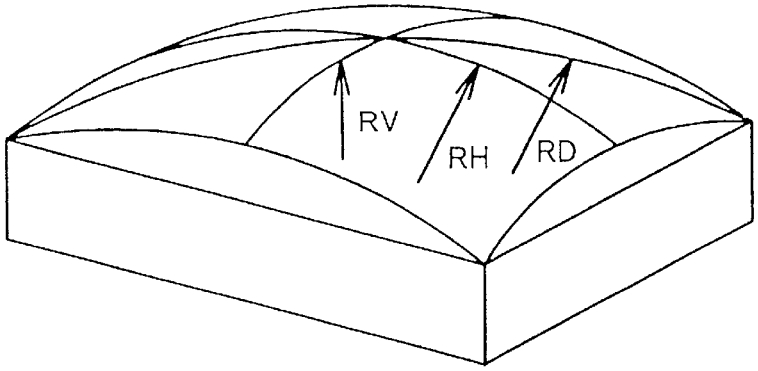
FIG. 2(b)
| | OUTSIDE (mm) | INSIDE (mm) |
|---|---|---|
| RD | R100,000 | R7130 |
| RH | R100,000 | R14700 |
| RV | R100,000 | R1810 |
FIG. 3
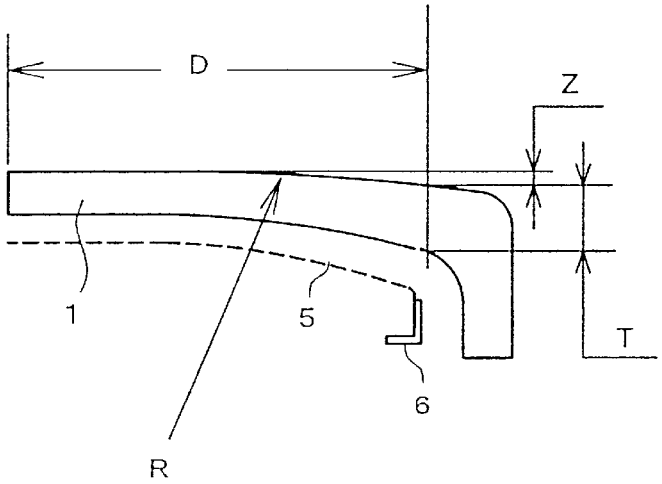

BRAUN COLOR CATHODE RAY TUBE HAVING SHADOW MASK HORIZONTAL PITCH NOVELTY

BACKGROUND OF THE INVENTION

Flattening the outer panel surface of a color Braun tube (color cathode ray tube) makes it possible to improve the viewability of on-screen picture images. However, in a shadow mask type of Braun tube, it is necessary for the effective surface section of the shadow mask to have a curvature in order to maintain the mechanical strength of the shadow mask. It is also important to maintain a uniform distance between the shadow mask and the phosphor screen on the inner surface of the panel. To this end, a scheme is known for giving a curvature to the inner surface of the panel opposing the shadow mask, while at the same time flattening the outer surface of the panel. However, if the glass thickness at the periphery of the panel is larger than that at the center of the panel, the following problems would occur: (1) the brightness of the screen is degraded in the periphery of the screen; and (2) the panel is difficult to manufacture. Accordingly, in cases where the outer surface of the panel is flat, it is impossible to extremely increase the curvature of the inner surface of the panel. In this case, it is impossible to give a sufficient curvature to the shadow mask, so that the strength of the shadow mask becomes a problem.

As a method of improving the strength of a shadow mask having, a small curvature (large radius of curvature), a technique for forming beads or irregular bent/curved portions within the effective surface area of the shadow mask is described in U.S. Pat. No. 5,506,466. This technique has the problem that the beads and the irregular bent/curved portions of the shadow mask are projected onto the phosphor screen.

U.S. Pat. No. 4,136,300 discloses the idea of giving a curvature to the shadow mask by varying the pitch of the shadow mask with respect to a panel having flat inner and outer surfaces. However, this patent has no disclosure of a construction which includes an in-line type electron gun and a dot-type phosphor screen. In addition, this document describes a method of forming a curvature on a shadow mask in the case where the inner surface of the panel is flat and the shadow mask includes slots, but the document includes no description of practical problems and constructions.

A technique for changing electron beam spacing (so-called S-size) together with the deflection angle of an electron beam in order to allow the curvature of the shadow mask to be larger than that of the panel inner surface is described in the International Display Workship (IDW) 1998 at pp. 413–416. This technique requires an electromagnetic quadrupole for varying the S-size together with the deflection angle. U.S. Pat. No. 5,479,068 describes a technique for enlarging the vertical pitch of the apertures of a shadow mask to improve color purity tolerances and electron beam transmissivities in a Braun tube which has an in-line type of electron gun and a dot-type of phosphor screen. However, this document has no description of a shadow mask having a curved surface of the strength thereof.

SUMMARY OF THE INVENTION

The present invention relates to a color picture tube, such as that used in a TV broadcasting receiver set, of the type in which the outer surface of the panel is flat and no high resolution is needed, but in which the brightness of the screen is important. Specifically, the color picture tube according to the present invention includes a panel having an outer surface whose equivalent radius of curvature is 10,000 mm or more and a press-formed type of shadow mask, and the horizontal pitch of apertures in the center of the shadow mask is 0.6 mm or more. The structure of the phosphor screen is not a stripe-type, but is a delta type, and an electron gun is arranged in the color picture tube in an in-line manner. This construction makes it possible to easily vary the pitch of the shadow mask in the direction of the Y-axis, while enjoying the benefit of self-convergence of the in-line type electron gun, thereby realizing the required curvature of the shadow mask.

According to the present invention, in the above-described construction, in order that the required landing tolerance can be ensured and the required luminance of the phosphor screen can be ensured, the delta shape of the arrangement of the shadow mask apertures is made vertically long to prevent degradation of landing tolerances, other than the horizontal landing tolerance. In addition, the shape of each of the shadow mask apertures is made vertically long to ensure sufficient luminance, as required.

BRIEF DESCRIPTION OF THE DRAWINGS

FIG. 2(*a*) is a perspective view illustrating a panel shape and FIG. 2(*b*) is a table of dimensions;

FIG. 3 is a partial sectional view illustrating an equivalent radius of curvature of the panel;

DESCRIPTION OF THE PREFERRED EMBODIMENT

Figure 1:
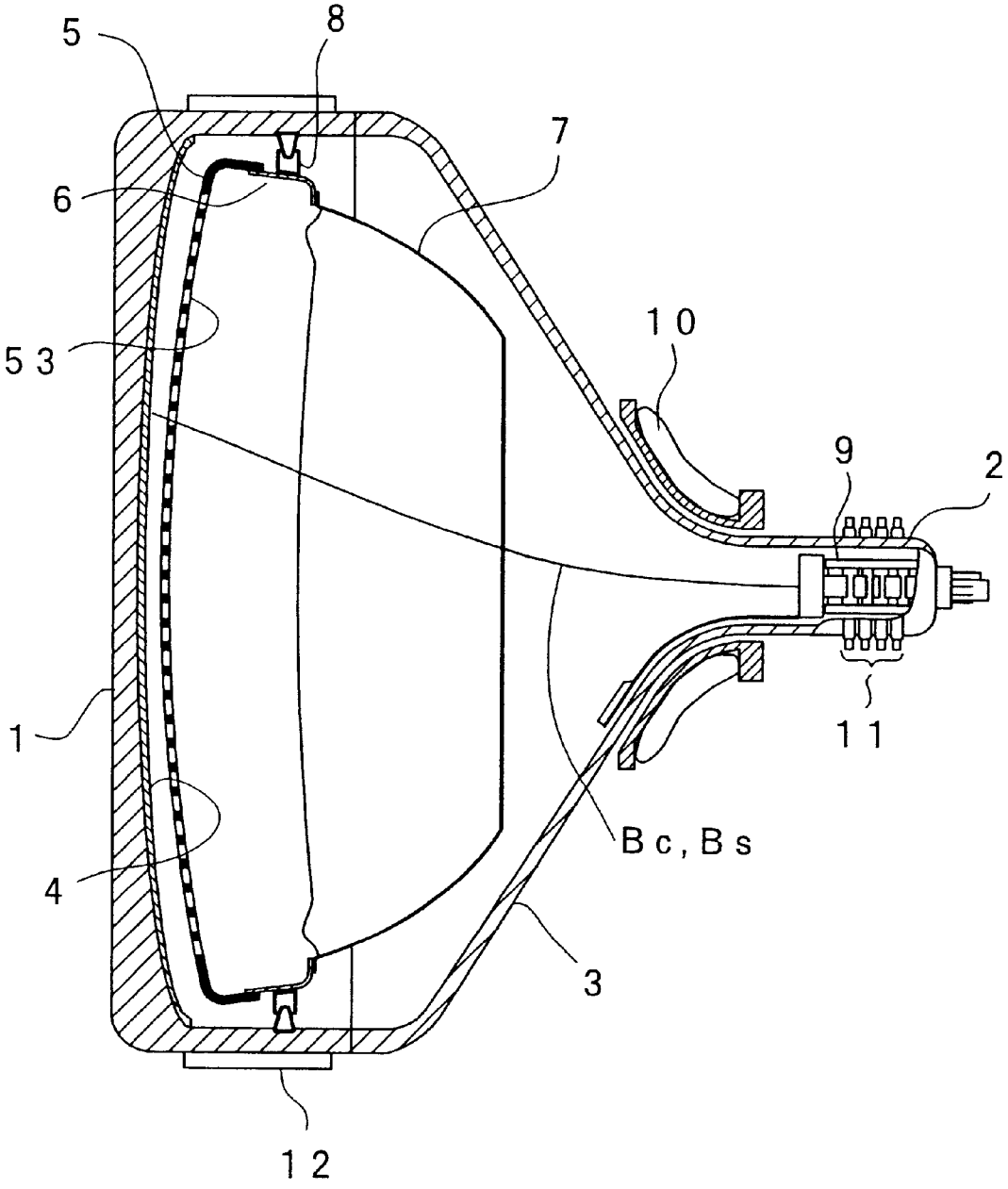
FIG. 1 is a schematic axial cross-sectional view of the color picture tube according to the present invention.

FIG. 1 is a schematic axial cross-sectional view of a Braun tube for a 34V size wide screen TV receiver. A panel 1 has an outer surface which is flat and an inner surface which is curved. A neck 2 contains an electron gun having an in-line arrangement, and the neck 2 is connected to the panel 1 by a funnel 3. Phosphors are formed on a phosphor screen 4 in a delta pattern, and a shadow mask 5 having multiple holes is supported by a support frame 6 in spaced relationship with the phosphor screen 4. The shadow mask 5 is fitted to the panel 1 by way of a spring 8. The shadow mask 5 has an effective surface 53 having multiple holes through which electron beams pass. This shadow mask 5 is formed by a press. An inner magnetic shield 7 is set on the support frame 6. A deflection yoke 10 deflects a center electron beam Bc and both side electron beams Bs, and a magnet assembly 11 adjusts the convergence and the purities of the election beams. A tension band 12 prevents the implosion of the tube envelope. The reason why the outer surface of the panel 1 is flat and the inner surface of the panel 1 has a radius of curvature is to allow the shadow mask 5 to have a radius of curvature. The thickness of the central portion of the panel 1 is 16.9 mm, and the peripheral portion of the panel 1 has a larger glass thickness because of the difference in radius of curvature between the inner and outer surfaces of the panel 1. FIG. 2 shows the shape of the curved surface of the panel 1. If the curved surface of the panel 1 is not a spherical surface, the equivalent radius of curvature R of the curved surface is, as shown in FIG. 3, defined as follows from the amount of depression of the peripheral portion with respect to the central portion:

$$R=(D^2+Z^2)/(2Z),$$

Here, D represents a length which is half of the effective diameter of the curved surface, and Z represents the distance between the surface at the center of the panel 1 and a parallel plane through the edge portion of the effective surface. If the curved surface is an aspherical surface, this equivalent radius of curvature can be defined with the X-axis, the Y-axis and the diagonal axes of the curved surface.

An important point which relates to the strength of the shadow mask 5 is the radius of curvature taken in the direction of the Y-axis. The present invention can realize the required shadow mask strength even if the radius of curvature in the direction of the Y-axis is 10,000 mm or more.

Figure 4:
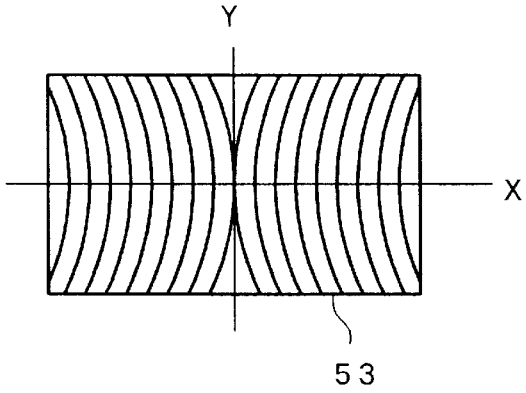
FIG. 4 is a diagram showing an example of a stripe screen whose pitch is changed in the direction of the Y-axis.
Figure 5:
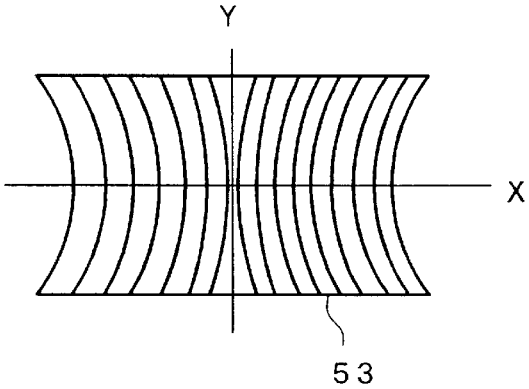
FIG. 5 is a diagram showing another example of a stripe screen whose pitch is changed in the direction of the Y-axis.
Figure 6:
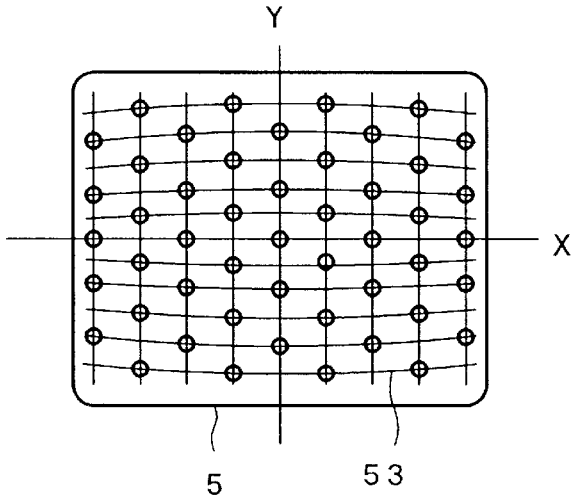
FIG. 6 is a diagram showing an example of the arrangement of the apertures of an in-line dot type of shadow mask used in a Braun tube for a display device.

In the case of a press forming type of shadow mask, if the curvature of its effective surface is not sufficient, i.e., if the radius of curvature is not sufficiently small, the problem of strength occurs. In general, shadow masks have curved surfaces which approximate in shape the inner surfaces of panels. In the case of a panel having a flat outer surface, it is difficult to give a sufficient radius of curvature to the inner surface of the panel. For this reason, one of the largest problems of a Braun tube having a panel with a flat outer surface is in its shadow mask strength. As one method of giving a larger radius of curvature to a shadow mask than to the inner surface of the panel, there is a technique which calls for making the pitch of the shadow mask larger in the central portion thereof than in the peripheral portion thereof. This technique is described in U.S. Pat. No. 4,136,300 of Morrell. However, as stated by Morrell, if the shadow mask is to be given a radius of curvature in the direction of the Y-axis, the slot columns are curved, as shown in FIG. 4, so that it becomes difficult to form stripes on a phosphor screen. In the example shown in FIG. 4, the phosphor stripes become discontinuous on both sides of the screen. If the phosphor stripes are made continuous on both sides of the screen, the external shape of the effective surface assumes an extreme pin-cushion shape, which is not practical, as shown in FIG. 5. Accordingly, in the related example, a variation in the horizontal pitch of the shadow mask in the direction of the Y-axis had a value far smaller than 1%. The above-cited United States patent of Morrell has a description to the effect that a similar technique can also be applied to a delta-type electron gun or a dot type of phosphor screen. However, in the United States patent of Morrell, there is no suggestion as to a combination of an in-line type of electron gun and a delta type of phosphor screen. In the field of Braun tubes for computer monitors, there has existed a combination of an in-line electron gun and a phosphor dot screen. In this case, however, as shown in FIG. 6, the shadow mask apertures are arrayed so as not to deviate greatly from lines along the Y-axis, as in the case of slots for a phosphor stripe screen.

Figure 7:
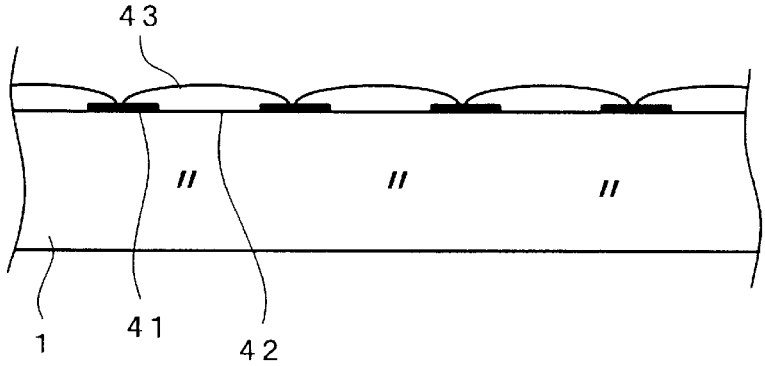
FIG. 7 is a diagram showing an example of the cross-sectional structure of a phosphor surface.

As described above, there has not yet been suggestion of an idea which intends to incorporate an in-line electron gun and a delta type of phosphor screen into a Braun tube, such as that for a TV receiver, which is comparatively low in resolution and requires a high brightness. FIG. 7 shows the basic structure of the phosphor screen of a color Braun tube. A black matrix 41 is formed on the inner surface of the panel 1, and holes 42 in the black matrix 41 determine the transmissivity of light emitted from phosphors 43. The holes 42 of the black matrix 41 may be stripe-shaped, but in this case as well, they are called holes for convenience's sake.

Figure 8:
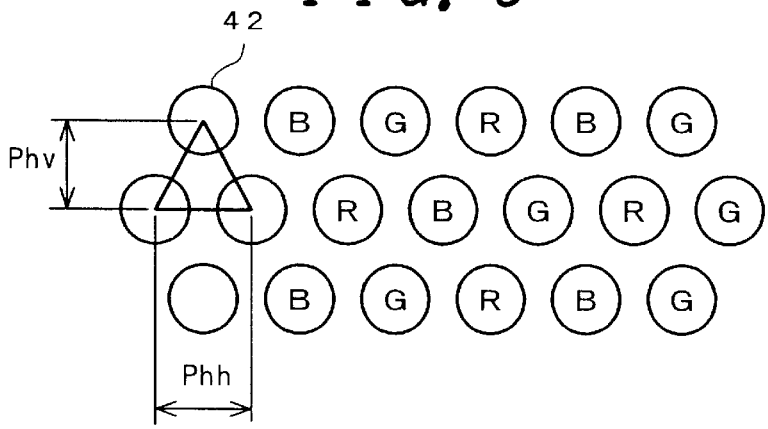
FIG. 8 is a diagram showing an example of the arrangement of dot tppe phosphors.
Figure 9:
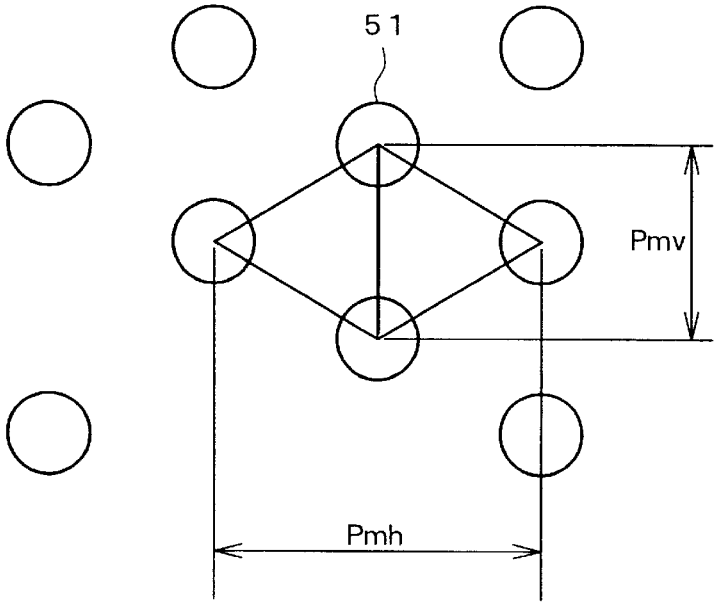
FIG. 9 is a diagram showing an example of the arrangement of shadow mask apertures.

According to the present invention, in a Braun tube which has a panel with a flat outer surface and which is comparatively low in resolution, like a Braun tube for a TV receiver, an in-line type of electron gun and a delta type of phosphor screen arrangement are combined with each other to obtain a sufficient shadow mask strength. Specifically, the horizontal pitch of the shadow mask apertures is varied in the direction of the Y-axis to give a sufficient radius of curvature in the direction of the Y-axis. The delta type of phosphor screen has dot trios each formed of phosphor dots for the three colors: red (R), green (G) and blue (B), which are arrayed in a triangle as shown in FIG. 8. The shape of the triangle has variations. The shape of the triangle is determined by the arrangement of the shadow mask apertures. Specifically, as shown in FIG. 9, the shape of the triangle depends on the horizontal pitch Pmh, the vertical pitch Pmv and the shapes of the shadow mask apertures. If the arrangement of the shadow mask apertures is a regular triangle, then $Pmh=\sqrt{3}Pmv$.

If the space between adjacent ones of the holes 42 is the same, the landing of electron beams is more difficult in the case of the triangle type of phosphor screen than in the case of a stripe type of phosphor screen. This is because, in the case of the stripe type of phosphor screen, attention needs only to be paid to horizontal landing, but, in the case of the triangle type of phosphor screen, not only horizontal landing, but also omni-directional landing becomes a concern. In addition, at the same time as the landing of electron beams, the brightness of the phosphor screen, i.e., the hole transmissivity of the black matrix, must be considered. If the sizes of the holes are reduced, the tolerance of landing increases, but the brightness of the phosphor screen decreases.

Figure 10A:
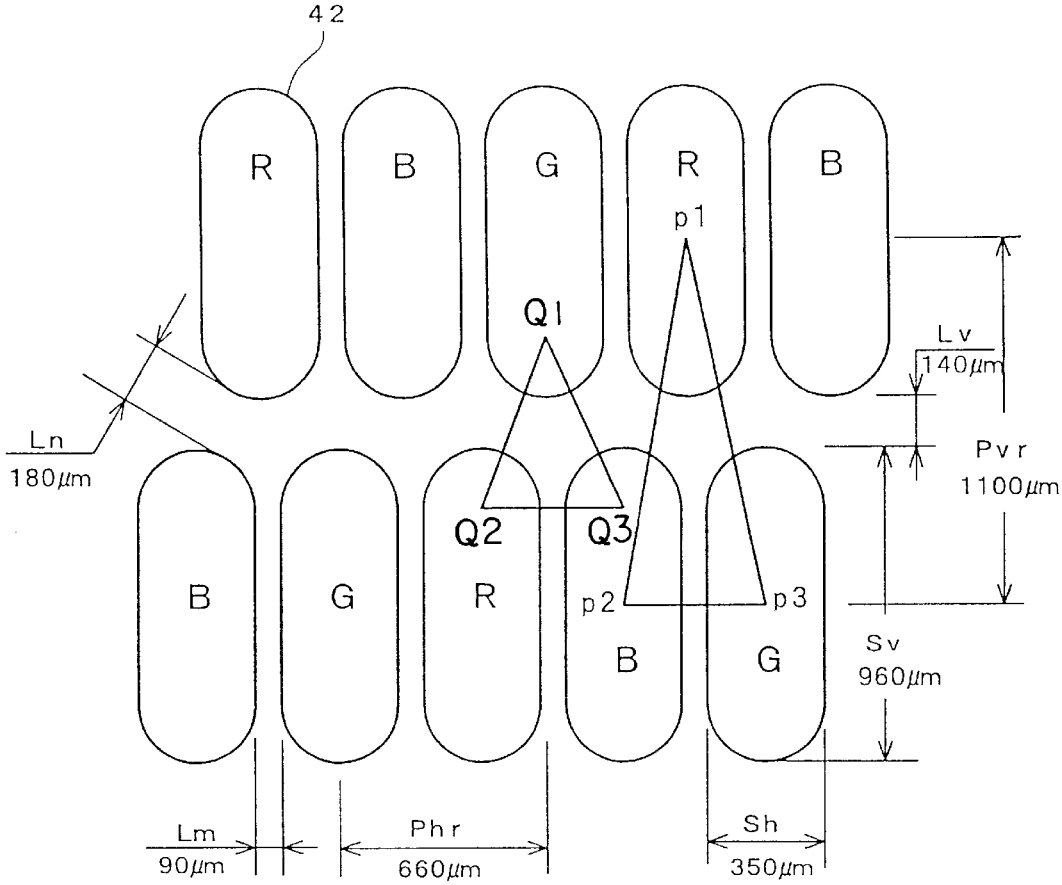
FIGS. 10(*a*) and 10(*b*) are diagrams showing an example of a phosphor screen according to an embodiment of the present invention and a comparative stripe screen, respectively.
Figure 10B:
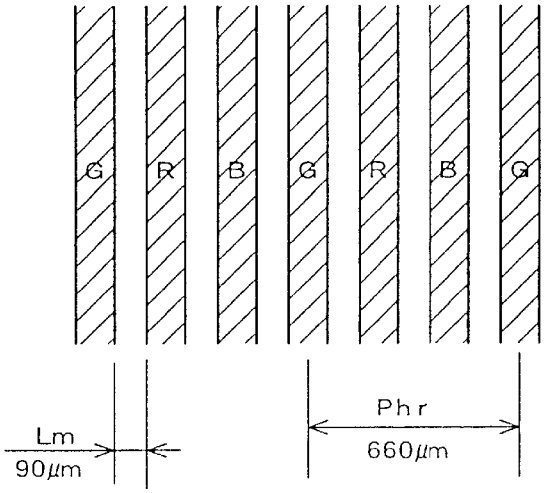

FIG. 10(*a*) shows one embodiment of the present invention, and a phosphor stripe screen is comparatively shown in FIG. 10(*b*). The horizontal resolution Phr of the present embodiment and that of the stripe type of example are the same, 660 $\mu$m. If their horizontal landing tolerances are made the same, 90 $\mu$m, the embodiment of the present invention can increase the hole transmissivity to a greater extent than the stripe type screen, because the present embodiment has a larger hole pitch. In the case of the phosphor stripe screen, no vertical landing error may be considered. In the embodiment of the present invention, a landing tolerance Ln other than a horizontal landing tolerance Lm is made larger than the horizontal landing tolerance Lm, whereby the problem of the landing tolerance, other than the horizontal landing tolerance, is substantially solved. To enable this, in the embodiment of the present invention, as shown in FIG. 10, the configuration of a trio of holes P1–P2–P3, which corresponds to a trio of three color phosphors R–G–B, is a vertically long triangle. Only when the configuration of the trio is a vertically long triangle, with the shapes of the holes remaining circular, will the hole transmissivity be lower. For this reason, the shape of each of the holes is also a vertically long slot-like shape. The shape of each of the holes of the present embodiment is similar to that of a race track in which two straight lines are connected by top and bottom arcs. Since the top and bottom of the slot-like shape are arcuate, it is possible to increase the vertical landing tolerance.

In the embodiment shown in FIG. 10(*a*), a triangle Q1–Q2–Q3 is also vertically long, which triangle is formed by connecting the respective centers of three adjacent arcs which are arranged in a triangle. Accordingly, it is possible to ensure a sufficient vertical landing tolerance.

Figure 11:
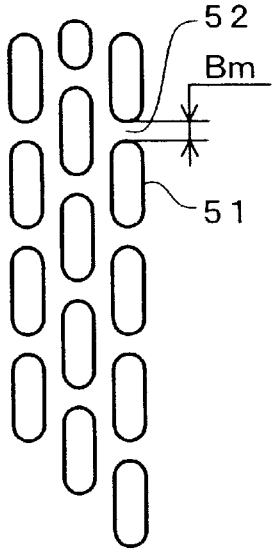
FIG. 11 is a diagram showing an example of a shadow mask which corresponds to a stripe type phosphor screen.
Figure 12:
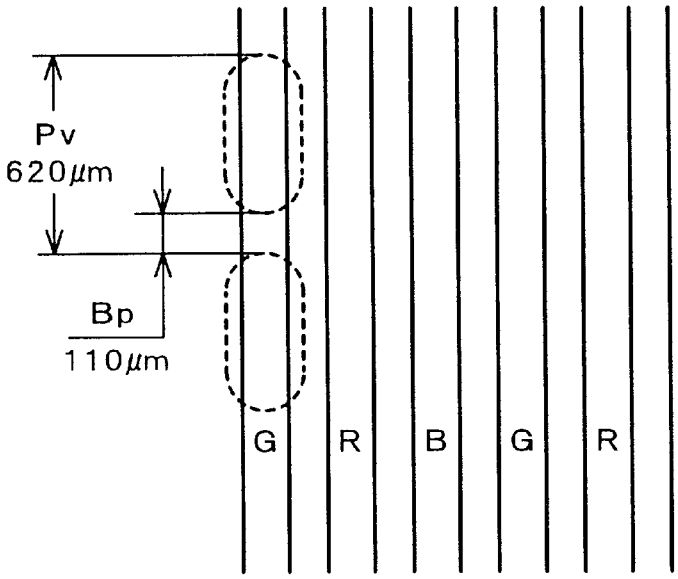
FIG. 12 is a diagram showing an example of the stripe type of phosphor screen.

In the case of a phosphor stripe screen as well, as shown in FIG. 11, the shadow mask has successive slots 51 with bridges 52 interposed between adjacent ones of the slots 51. FIG. 12 shows the phosphor stripe type screen, and each dotted line area denotes a location on which an electron beam is to strike. As shown in FIG. 12, on the phosphor screen, since no electron beam strikes on a portion Bp which corresponds to the bridge 52 of the shadow mask, the portion Bp does not contribute to the brightness of the screen. In the present embodiment shown in FIG. 10(*a*), the vertical hole space Lv is 140 $\mu$m in order to ensure a large landing tolerance, in addition to the horizontal landing tolerance. Even if such a large landing tolerance is ensured, the influence of this landing tolerance on the brightness of the screen is 140 $\mu$m/1100 $\mu$m≈12.7%, and is smaller than the proportion of the shadows of bridges in the case of general stripes. The hole transmissivity of this shadow mask differs according to the aspect ratio of each hole. If the aspect ratio of each hole is 1.5 or more, it is possible to make the efficiency of utilization of light of the phosphors greater than or equal to those of phosphor stripe screens, while ensuring the required landing tolerance in the vertical direction. If the aspect ratio of each hole is 2.0 or more, the efficiency of utilization of light can be made higher than in the case of general phosphor stripe screens.

Figure 13:
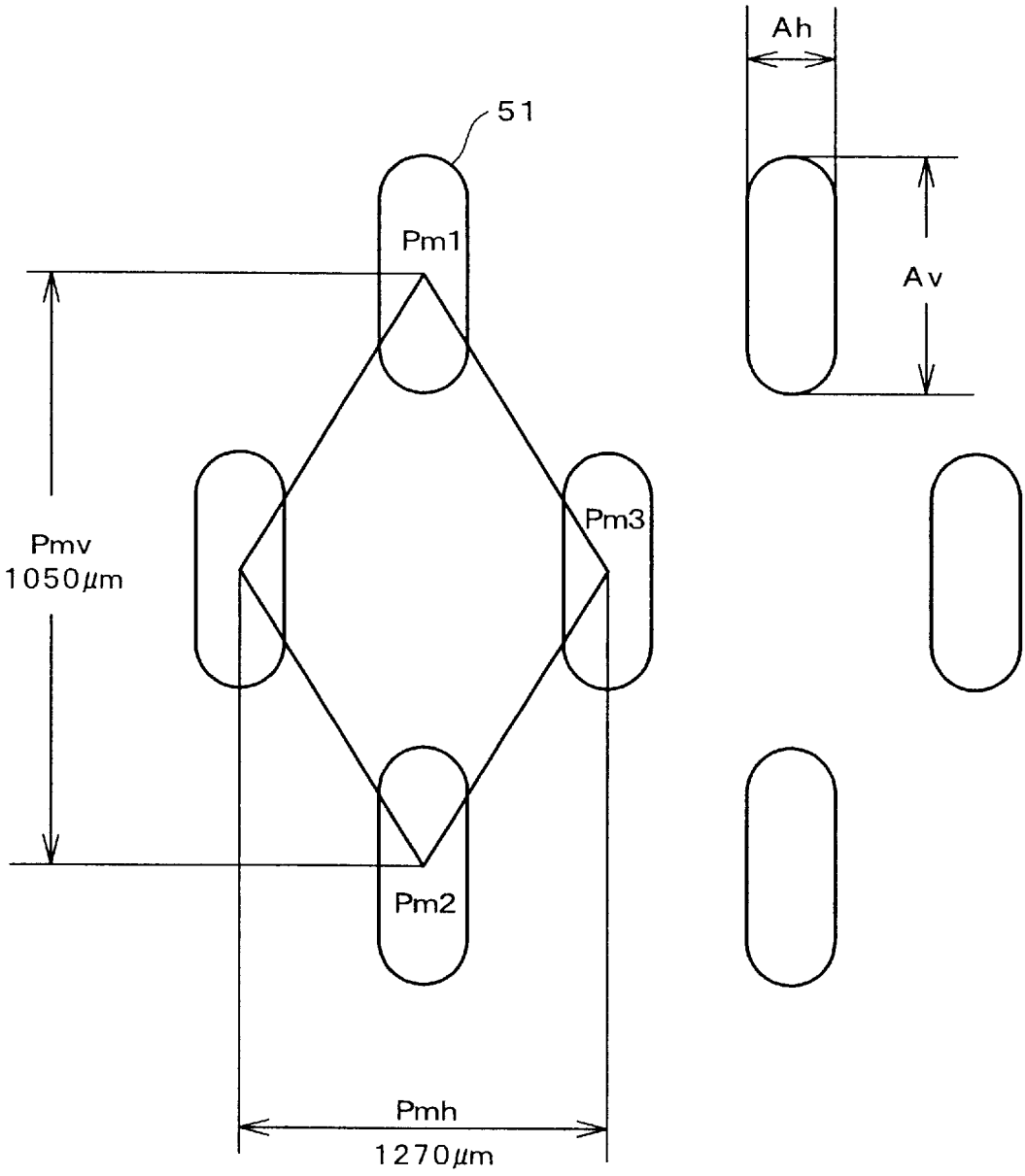
FIG. 13 is a diagram showing an example of a shadow mask according to the embodiment of the present invention.

FIG. 13 shows the arrangement of shadow mask apertures which corresponds to the phosphor screen shown in FIG. 10(*a*). In the present embodiment, as shown in FIG. 10(*a*), the aperture arrangement Pm1–Pm2–Pm3 of the shadow mask is in the form of a vertically long triangle. If the three holes of each hole trio of the phosphor screen are arranged in a regular triangle, the aperture arrangement Pm1–Pm2–Pm3 of the shadow mask is in the form of a regular triangle. In this case, the relationship between the horizontal pitch Pmh and the vertical pitch Pmv is $Pmh=\sqrt{3}Pmv$, but in the present embodiment, $Pmh<\sqrt{3}Pmv$. If the horizontal pitch Pmh of the shadow mask is 1.0 mm or more, the landing tolerance and the optical transmissivity of the holes of the phosphor screen can be made sufficiently large. In addition, if the horizontal pitch Pmh of the shadow mask is 0.6 mm or more, it is possible to ensure the landing tolerance, while maintaining a resolution higher than or equal to that of a stripe type of color Braun tube for a TV receiver. In the present embodiment, the horizontal pitch Pmh is 1.27 mm, while the vertical pitch Pmv is 1.05 mm. Each aperture 51 has the shape of a race track having top and bottom arcs. Letting Av and Ah be, respectively, the vertical and horizontal sizes of the aperture 51, Av>Ah is obtained. As in the case of the above-described embodiment, for the holes, if Av≧1.5 Ah, it is possible to make the efficiency of utilization of light of the phosphors greater than or equal to those of phosphor stripe screens, while ensuring a sufficient landing tolerance in the vertical direction. If Av≧2.0 Ah, the efficiency of utilization of light can be made higher than in the case of phosphor stripe screens.

Figure 14A:
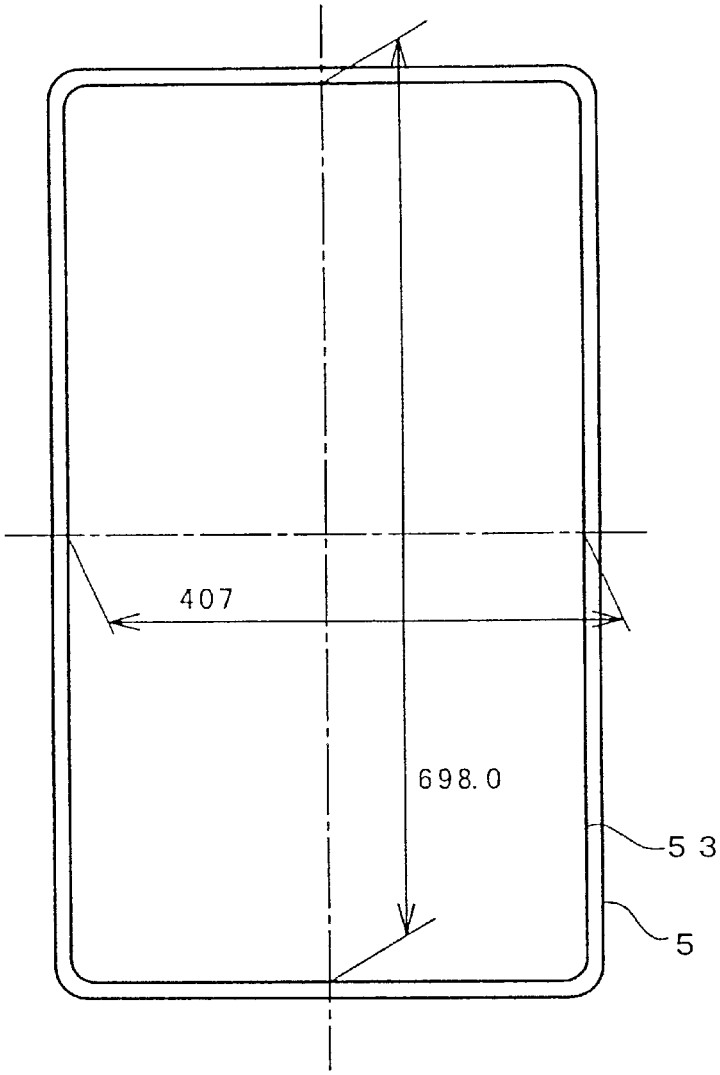
FIGS. 14(*a*), 14(*b*) and 14(*c*) are plan, side and end views, respectively, is a view showing an example of a pressed shadow mask according to the present invention.
Figure 14B:
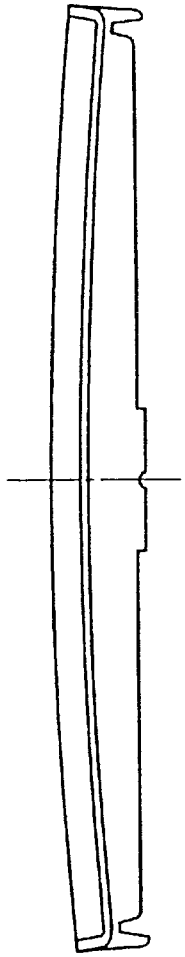
Figure 14C:
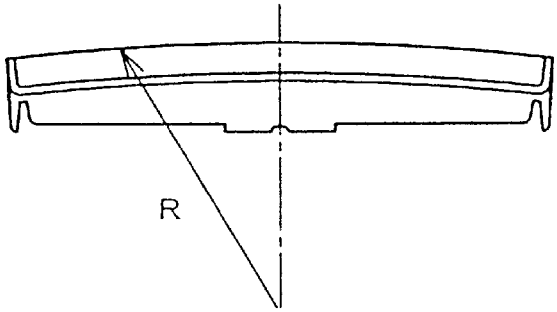

The present invention makes it possible to increase the strength of a shadow mask by freely changing the horizontal pitch of the shadow mask in the direction of any of the X-axis, the Y-axis and the diagonal axes, while utilizing the advantages of an in-line electron gun. Although it has been nearly impossible to increase the horizontal pitch of a shadow mask for the related art stripe type of phosphor screen by 5% or more, particularly in the direction of the Y-axis, the present invention can easily realize such an increase. FIGS. 14(*a*) to 14(*c*) show a pressed shadow mask of the present embodiment. Multiple apertures are formed in the effective surface 53 of the shadow mask. Table 1 shows how the radius of curvature of the shadow mask in the direction of the Y-axis varies in response to a change in the horizontal pitch of the shadow mask. It is assumed here that the radius of curvature of the shadow mask is equal to the radius of curvature of the inner surface of the panel if the horizontal pitch of the shadow mask is constant on the Y-axis. It is also assumed that the horizontal pitch of the shadow mask at the center thereof is 0.63 mm and the q-size (the distance between the shadow mask and a phosphor screen) is 14.64 mm. The q-size includes a q-size taken along the trajectory of the electron beam and a q-size taken along the tube axis of the Braun tube. In Table 1, the q-size taken along the tube axis is used for comparison. In Table 1, the term "Y-axis edge portion of effective-surface" indicates a point which is located at 200 mm from the center of the shadow mask in the direction of the Y-axis.

TABLE 1

| PITCH IN DIRECTION OF Y-AXIS | Q-SIZE AT Y-AXIS EDGE PORTION OF EFFECTIVE SURFACE | RADIUS OF CURVATURE | RATIO |
|---|---|---|---|
| UNIFORM PITCH | 14.64 mm | 1,810 mm | 100% |
| 5% VARIABLE PITCH | 15.37 mm | 1,699 mm | 94% |
| 10% VARIABLE PITCH | 16.10 mm | 1,604 mm | 89% |
| 20% VARIABLE PITCH | 17.57 mm | 1,435 mm | 79% |

As shown in Table 1, if the 5% variable pitch is used, the radius of curvature in the direction of the Y-axis can be made 94%, and if the 10% variable pitch is used, the radius of curvature in the direction of the Y-axis can be made 89%. According to the present invention, the horizontal pitch of the shadow mask can be freely changed in the direction of any of the Y-axis, the X-axis and the diagonal axes. However, to retain the symmetry of a triangular arrangement of holes, it is preferable to uniformly vary the horizontal pitch in radial directions from the center of the shadow mask. In addition, by uniformly varying the horizontal pitch in the radial directions, it is possible to increase the strength of the shadow mask in a balanced manner in each of the directions. According to this construction, the grading of the horizontal pitch Pmh to the edges of the screen can easily be 20% in the direction of a shorter axis, 35% or more in the direction of a longer axis, and 40% or more in the direction of a diagonal axis.

In the present embodiment, there is a case where the horizontal pitch becomes excessively large in a diagonal corner portion of the screen. To cope with this, the horizontal pitch is made extremely small at the center of the screen, and in the periphery of the screen, the necessary horizontal pitch is set. This is because the landing tolerance may be small at the center of the screen. In addition, in the case of a panel having a flat outer surface, the peripheral thickness of the glass is much larger than the central thickness, and so the optical transmissivity of the panel decreases in the periphery thereof Accordingly, even if the horizontal pitch at the center of the screen is made small to decrease the hole transmissivity, the uniformity of luminance over the entire screen is improved. According to this construction, the horizontal pitch of the shadow mask can be increased by 50% or 100% in each diagonal edge portion with respect to the center of the shadow mask. Similarly, in any of the shorter-axis and longer-axis peripheral portions of the screen, if the hole transmissivity is made larger than the center of the screen, it is possible to retain the uniformity of luminance. Incidentally, the diagonal corner portion, the short-axis peripheral portion and the longer-axis peripheral portion denote locations which are 10 mm inward of an end of either diagonal axis, an end of the shorter axis and an end of the longer axis, respectively.

The vertical pitch of the shadow mask can freely be determined since the vertical pitch does not relate to the radius of curvature of the shadow mask. The vertical pitch of the shadow mask may be selected so that moiré caused by the interference of the vertical pitch with the scanning lines of an electron beam can be minimized. The vertical pitch may basically be uniform over the entire screen. However, if the cross-sectional shape of the electron beam differs between the center and the periphery of the screen, the vertical pitch can be changed between the center and the periphery of the screen.

Figure 15:
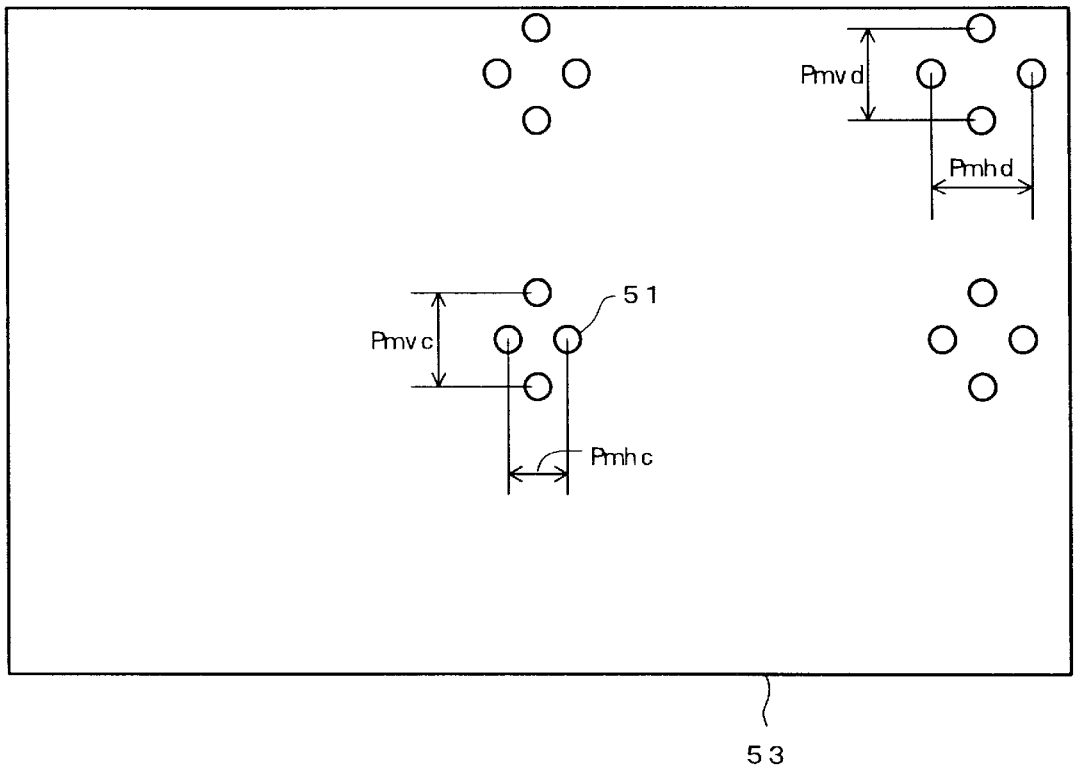
FIG. 15 is a diagram showing an example of the arrangement of shadow mask apertures according to the present invention.

FIG. 15 shows one example of a shadow mask aperture arrangement. The shapes of trios are such that the trio located at the center of the screen has the maximum vertital length and the extent of the vertical length of each of the trios becomes smaller toward the periphery of the screen. In the present example, even the trios located in the respective diagonal corners are vertically long. Specifically, in the central portion of the shadow mask, $Pmhc<\sqrt{3}Pmvc$, and in each diagonal corner, $Pmhd<Pmvd$.

Figure 16:
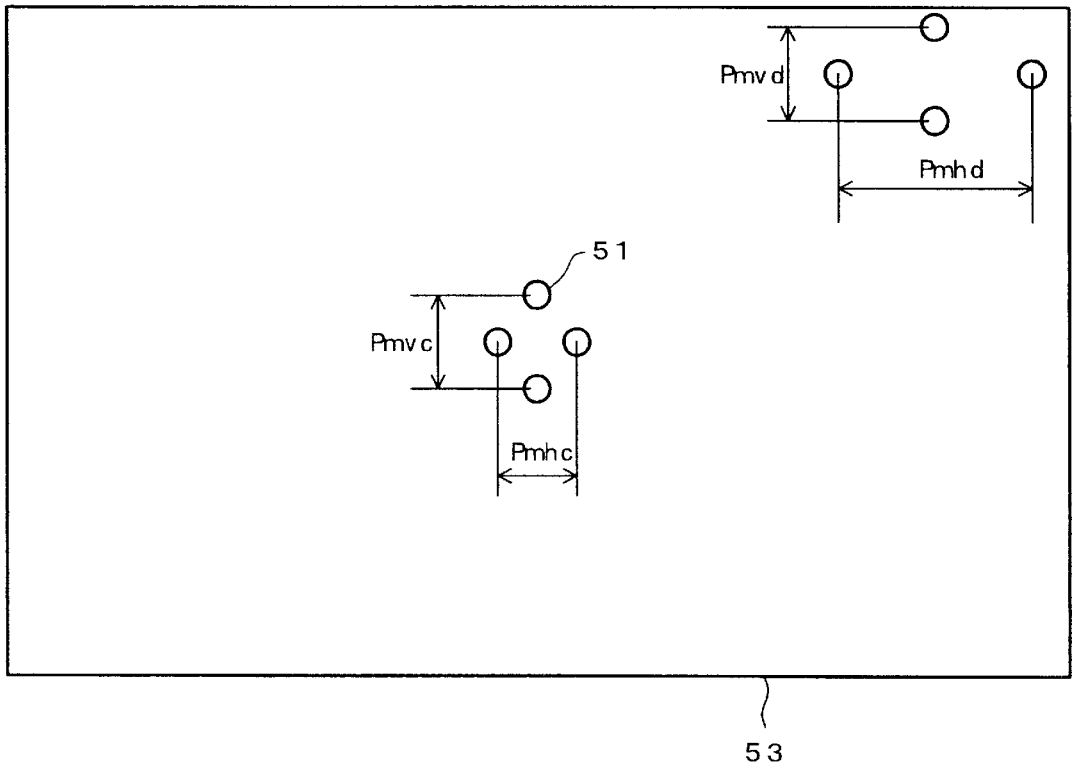
FIG. 16 is a diagram showing another example of the arrangement of shadow mask apertures of the present invention.

FIG. 16 shows one example of a shadow mask aperture arrangement for the case in which the grading of the horizontal pitch of its shadow mask is very large. In the case where the horizontal pitch is very large, even if $Pmhc<\sqrt{3}Pmvc$ in the central portion of the shadow mask, $Pmhd\geqq\sqrt{3}Pmvd$ in each diagonal corner. In this case, in each diagonal corner, letting Av and Ah be, respectively, the vertical and horizontal sizes of the aperture 51 $Av\leqq Ah$ can be obtained. The reason for this is to ensure a vertical landing tolerance in each corner portion and increase the transmissivity of the shadow mask, thereby ensuring the brightness of the screen.

What is claimed is:

1. A color picture tube comprising:

a panel having an outer panel surface whose equivalent radius of curvature taken in the direction of its Y-axis is 10,000 mm or more, and an inner panel surface whose equivalent radius of curvature is smaller than the equivalent radius of curvature of the outer panel surface in the directions of its X-axis, the Y-axis and its diagonal axes;

delta type phosphors formed on the inner panel surface;

a press forming type of shadow mask being opposed to the inner panel surface and having multiple apertures arranged at a horizontal pitch Pmh and a vertical pitch Pmv, the horizontal pitch being larger by 5% or more at an end of a shorter axis of an effective surface of the shadow mask than in the center of the shadow mask, the horizontal pitch being 0.6 mm or more, and $Pmh<\sqrt{3}Pmv$; and an electron gun arranged in an in-line manner.

2. A color picture tube according to claim 1, wherein the horizontal pitch at the end of the shorter axis of the effective surface of the shadow mask is larger by 10% or more than the horizontal pitch in the center of the shadow mask.

3. A color picture tube according to claim 1, wherein letting Av and Ah be, respectively, an aperture size taken in the direction of the Y-axis and an aperture size taken in the direction of the X-axis in the center of the shadow mask, $Av>Ah$.

4. A color picture tube according to claim 1, wherein letting Av and Ah be, respectively, an aperture size taken in the direction of the Y-axis and an aperture size taken in the direction of the X-axis in the center of the shadow mask, $Av\geqq 1.5Ah$.

5. A color picture tube according to claim 1, wherein at an end of the Y-axis of the effective surface of the shadow mask, the relationship between the horizontal pitch Pmh and the vertical pitch Pmv is $Pmh<\sqrt{3}Pmv$.

6. A color picture tube according to claim 1, wherein at the end of the diagonal axes of effective surface of the shadow mask, the relationship between the horizontal pitch Pmh and the vertical pitch Pmv is $Pmh<\sqrt{3}Pmv$.

7. A color picture tube according to claim 1, wherein the horizontal pitch Pmh of the shadow mask is 1.0 mm or more.

8. A color picture tube according to claim 1, wherein the horizontal pitch Pmh of the shadow mask is larger in a periphery of the screen than in the center of the screen and is nearly constant in radial directions.

9. A color picture tube according to claim 1, wherein on shorter sides of the effective surface of the shadow mask, the horizontal pitch is larger in corner portions than on the longer axis.

10. A color picture tube comprising:

a panel having an outer panel surface whose equivalent radius of curvature taken in the direction of its Y-axis is 10,000 mm or more, and an inner panel surface whose equivalent radius of curvature is smaller than the equivalent radius of curvature of the outer panel surface in the directions of its X-axis, the Y-axis and its diagonal axes;

delta type holes of a black matrix formed on the inner panel surface, phosphors being formed in the respective holes and the distance between adjacent ones of the holes being the smallest in the horizontal direction;

a press forming type of shadow mask being opposed to the inner panel surface and having multiple apertures, the horizontal pitch of the apertures being larger in a periphery of the shadow mask than in the center of the shadow mask, the horizontal pitch in the center of the shadow mask being 0.6 mm or more; and an electron gun arranged in an in-line manner.

11. A color picture tube according to claim 10, wherein letting Sv and Sh be, respectively, a vertical size of the holes and a horizontal size of the holes, $Sv>Sh$.

12. A color picture tube according to claim 10, wherein letting Sv and Sh be, respectively, a vertical size of the holes and a horizontal size of the holes, $Sv \geqq 1.5Sh$.

13. A color picture tube according to claim 10, wherein letting Lv and Lm be, respectively, the vertical space between adjacent ones of the holes arranged in a delta pattern and the horizontal space between the adjacent ones, $Lv > Lm$.

14. A color picture tube according to claim 11, wherein letting Lv and Lm be, respectively, the vertical space between adjacent ones of the holes arranged in a delta pattern and the horizontal space between the adjacent ones, $Lv > Lm$.

15. A color picture tube according to claim 10, wherein a hole transmissivity is larger in diagonal corner portions of a screen than in the center of the screen.

16. A color picture tube according to claim 10, wherein a hole transmissivity is larger in longer-axis peripheral portions of a screen than in the center of the screen.

17. A color picture tube according to claim 10, wherein a hole transmissivity is larger in shorter-axis peripheral portions of a screen than in the center of the screen.

18. A color picture tube comprising:

a panel having an outer panel surface whose equivalent radius of curvature taken in the direction of its Y-axis is 10,000 mm or more, and an inner panel surface whose equivalent radius of curvature is smaller than the equivalent radius of curvature of the outer panel surface in the directions of its X-axis, the Y-axis and its diagonal axes;

delta type phosphors formed on the inner panel surface; and a press forming type of shadow mask being opposed to the inner panel surface and having multiple apertures having a horizontal pitch and a vertical pitch, the horizontal pitch in the center of the shadow mask being 0.6 mm or more, letting Pmhc and Pmhd be, respectively, the horizontal pitch in the center of the shadow mask and the horizontal pitch in each diagonal-axis end portion of an effective surface of the shadow mask, $Pmhd \geqq 1.5Pmhc$; and an electron gun arranged in an in-line manner.

19. A color picture tube according to claim 18, wherein $Pmhd \geqq 2.0Pmhc$.

20. A color picture tube according to claim 18, wherein letting Pmvc be the vertical pitch in the center of the shadow mask, $Pmhc < \sqrt{3}Pmvc$.

21. A color picture tube according to claim 18, wherein letting Pmvd be the vertical pitch in each diagonal-axis end portion of the effective surface of the shadow mask, $Pmhd < \sqrt{3}Pmvd$.

* * * * *